United States Patent [19]

Tsang et al.

[11] Patent Number: 4,658,116

[45] Date of Patent: Apr. 14, 1987

[54] HAND-HELD ELECTRICAL APPLIANCES

[75] Inventors: Fan K. Tsang; Fan W. Tsang, both of Kowloon; Ying S. Chan, Kennedy Town, all of Hong Kong

[73] Assignee: Techs Industrial Design Limited, Tsuen Wan, Hong Kong

[21] Appl. No.: 594,249

[22] Filed: Mar. 28, 1984

[51] Int. Cl.[4] ..... F24H 3/04; H05B 1/00

[52] U.S. Cl. ..... 219/370; 219/507; 219/364; 200/302.2; 361/189

[58] Field of Search ..... 219/507, 518, 496, 364, 219/370, 240, 243, 373, 369; 200/60, 61.6, 85 R, DIG. 25, DIG. 40, 157, 302.1, 302.2, 302.3; 362/802; 174/525; 361/189

[56] References Cited

U.S. PATENT DOCUMENTS

| | | | |
|---|---|---|---|
| 1,946,262 | 2/1934 | Adams | 219/373 X |
| 3,746,814 | 7/1973 | Lackey et al. | 200/157 |
| 3,982,089 | 9/1976 | Hytlin | 200/302.2 |
| 4,309,595 | 1/1982 | Long et al. | 219/370 |
| 4,365,140 | 12/1982 | Bast et al. | 219/240 X |
| 4,493,975 | 1/1985 | Yamamoto | 219/370 |

FOREIGN PATENT DOCUMENTS

| | | | |
|---|---|---|---|
| 2919598 | 11/1979 | Fed. Rep. of Germany . | |
| 3116285 | 2/1983 | Fed. Rep. of Germany . | |
| 2504366 | 10/1982 | France | 219/370 |
| 563088 | 7/1944 | United Kingdom . | |
| 586357 | 3/1947 | United Kingdom . | |
| 603958 | 6/1948 | United Kingdom . | |
| 752251 | 7/1955 | United Kingdom . | |
| 867476 | 5/1961 | United Kingdom . | |
| 1006368 | 9/1965 | United Kingdom . | |
| 1070720 | 6/1967 | United Kingdom . | |
| 1168501 | 10/1969 | United Kingdom . | |
| 1453179 | 10/1976 | United Kingdom . | |
| 1542686 | 3/1979 | United Kingdom . | |

OTHER PUBLICATIONS

Norelco Wall Mount Hair Dryer Instruction Pamphlet.

*Primary Examiner*—E. A. Goldberg
*Assistant Examiner*—M. M. Lateef
*Attorney, Agent, or Firm*—Stiefel, Gross, Kurland & Pavane

[57] ABSTRACT

An electrical hair dryer or like appliance has insulated power supply conductors, heating element, motor and fan, overload protection, thermal cutoffs, switches and controls, and the necessary internal wiring and thermal and electrical insulation confined in a hand-held housing having body and handle portions. The appliance has a pair of switches, both enclosed in the handle portion of the housing, for coupling power lines from an electrical source to the conductors to operate the appliance, which switches are sealed against water entry. The appliance also has an actuator external of the seal requiring continuous manual pressure to hold the switches in their closed position. When the pressure is released, for example if the appliance is dropped, the switches are open thereby avoiding risk of electric shock if, for example, the appliance, when connected to the supply, is immersed in water.

10 Claims, 7 Drawing Figures

HAND-HELD ELECTRICAL APPLIANCES

FIELD OF THE INVENTION

The present invention relates to hand-held electric appliances, for example electric hair dryers.

BACKGROUND OF THE INVENTION

The basic elements of a hand-held electric hair dryer consist of a housing, insulated power supply conductors, heating element, motor and fan, overload protection, thermal cutoffs, switches and controls, and the necessary internal wiring and thermal and electrical insulation.

Usual types of hand-held hair dryers include styler, roller brush, and pistol. In addition, some hand-held hair dryers are designed to include a dual voltage switch for travelling use.

There is a risk of electric shock and electrocution if a plugged-in hair dryer is immersed in water, even if the appliance is switched off. The present invention has for its object a hand-held appliance which provides improved electrical safety in this regard.

SUMMARY OF THE INVENTION

With this object in view the invention provides an appliance with switch means which is sealed on the supply side and has means requiring continuous manual pressure to hold the switch means in closed position. As a result release of manual pressure, for example if the appliance is dropped, opens the switch means. Immersion of the appliance in water then gives rise to no danger since the only part of the appliance connected to the supply is sealed against access by water.

The invention further includes an actuator requiring continuous pressure in one direction to hold the switch means closed and being movable in a direction at right angles to control different appliance functions. The actuator is preferably a one-piece plastics member which by reason of its construction incorporates spring action to prevent actuation of the switch means in the absence of manual pressure.

Other features of the invention will be apparent from the following description of one preferred embodiment of the invention given by way of example with reference to the accompanying drawings.

DESCRIPTION OF THE PREFERRED EMBODIMENT

Figure 1:
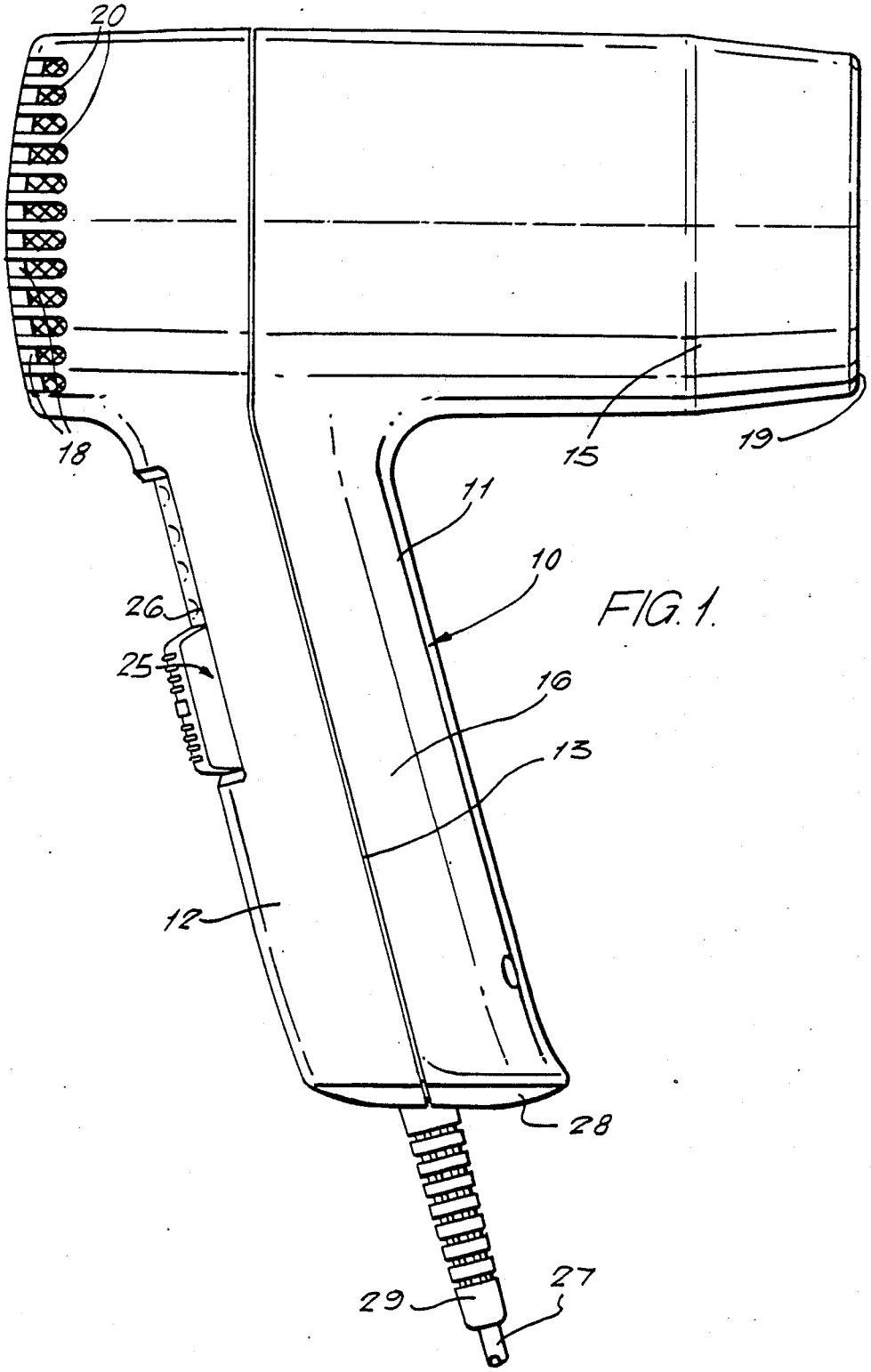
FIG. 1 is a side elevation of a hand-held hair dryer incorporating the invention.

Referring to the drawings, the hair dryer shown comprises a housing indicated generally by the reference numeral 10 (FIG. 1) which is formed in two parts, 11, 12, meeting on the line 13 and secured together by screws not shown. The housing is made of plastics material and comprises a body 15 with the handle 16. The body is apertured at one end to provide inlet openings 18 and has an outlet 19 at the other end. The inlet openings and outlet are protected by grilles 20, 21. The handle 16 contains a main switch 24 (to be described), the actuator 25 for which projects through a slot 26 in the housing portion 12 for manual actuation. Electrical power is supplied to the switch through a cord 27 which enters the end 28 of the handle 16 through a resilient bushing member 29.

The main switch designated generally 24 consists of two momentary switches, or micro-switches 35, held side by side, each connected to one of the conductors of the power cord 27, the pair thus providing a double pole switch. Each switch 35 has a projecting push button 36 and a resilient arm 37 which overlies it. Pressure on the arm depresses the push button to close the switch. The resilient arms of the two switches 35 are connected for movement together by a plastics strip 38 so that the switches make and break simultaneously.

The two switches 35, with actuating arms 37 and push buttons 36 are contained within an enclosure designated generally 40 which is totally sealed against water penetration. The enclosure comprises a main body member 42 of generally cylindrical form but with an opening 43 through which the push buttons and arms can project. The body member 42 may be of polycarbonate. The switches 35 are secured within this body member 42 with the aid of spacer members **44*a* and 44*b* (FIG. 4) and have input tabs 45 soldered to the conductors 46 and output tabs 47 soldered to output conductors 48. The body member 42 has at one end a deep flange 50 providing a recess receiving a resilient end seal member 51 e.g. of silicone rubber through which the leads 48 pass. This seal member 51 is compressed by an end cap 52 which is screwed on to the flange 50 with the aid of mating threads 53**.

The body member 42 provides a shoulder 55 about the flange 50. One end 56 of a resilient sealing sleeve 57 e.g. of silicone rubber or neoprene is stretched over the shoulder 55 in contact with the flange 50, the end cap 52, when screwed down upon the end seal 51 also compresses the end 56 of the sealing sleeve against the shoulder 55 on the body member 42, thereby effecting a seal at this area.

The other end 60 of body member 42 is cylindrical and the corresponding end 62 of the sealing sleeve 57 is stretched around it. A retainer cap 63 has an external flange 64 and this is screwed on to the body member 42 with the aid of threads 65 so that the flange 64 compresses the end 62 of the sealing sleeve on to the end of the body member 42 to effect a seal over this area. The spacer members **44*a*, 44*b* are retained between the inner end of the cap 63 and the inner end wall of the body member 42. The retainer cap 63 has also a longitudinal flange 68 at its end forming a recess 69 receiving an end seal member 71 through which the cord 27 passes to the interior of the enclosure. An end cap 72 is screwed down on to the flanges 68 with the aid of threads 73 to compress the seal member 71 about the cord 27. A silicone sealant is used on each of the end seal members 51, 71, as an additional sealing precaution. The sealant is used around the cord 27 where it passes through the seal member 71, and around leads 48 where they pass through seal member 51. Sealant is also placed in the openings of end caps 52, 72 around the respective leads as shown at 74, 75**.

It will be appreciated that because of the end seals 51 and 71, and the sealing sleeve 57 the switches 35 are completely sealed against the ingress of water. The enclosure 40 is located in the handle 16 by means of internal projections 80 and others not shown, when the parts 11, 12 of the housing are secured together.

The leads 48 are connected to a further switching arrangement designated generally 90 providing connections to a motor 91 (not shown in detail but of commutator type) driving fan 92, and the heater 93. The switching arrangement 90 provides in known manner three different motor speed and heat combinations.

Figure 5:
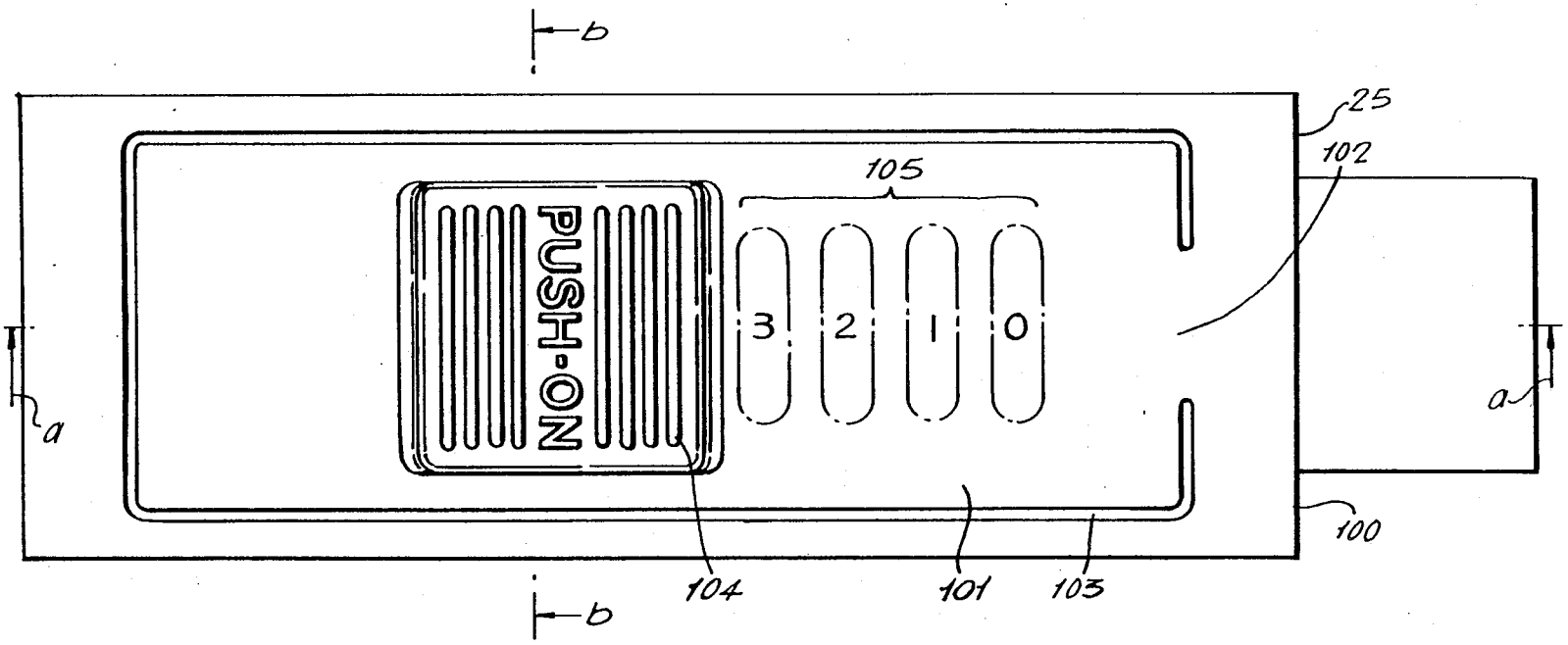
FIG. 5 is an elevation of an actuator forming of the hair dryer.
Figure 6:
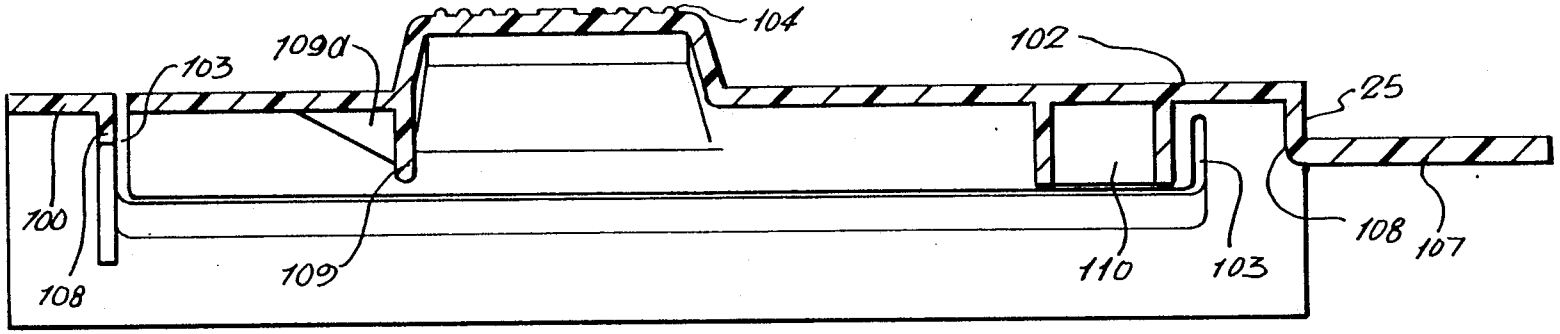
FIG. 6 is a section of the actuator taken on the line a—a in FIG. 5.
Figure 7:
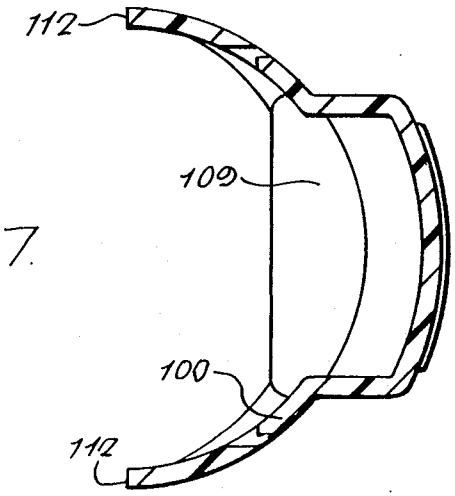
FIG. 7 is a transverse section of the actuator on the line b—b in FIG. 5.

The switch actuator 25 (shown in detail in FIGS. 5, 6 and 7) is a one-piece plastics moulding, for example of polycarbonate. The actuator has a generally semi-cylindrical main body 100 and a lever portion 101 which when unstressed fairs with the semi-cylindrical shape but is connected to the main body only by means of neck 102. The lever portion 101 is separated from the main body 100, apart from the neck 102, by a slit 103 extending around its periphery. The lever portion includes a serrated raised grip area 104, and markings 0, 1, 2, 3 are shown at 105. The main body 100 has an extension 107 at one end, and rigidifying flanges 108. The lever portion has on its underside an actuator flange 109 rigidified by web **109*a* and an open box 110**, for the purposes to be described.

Figure 2:
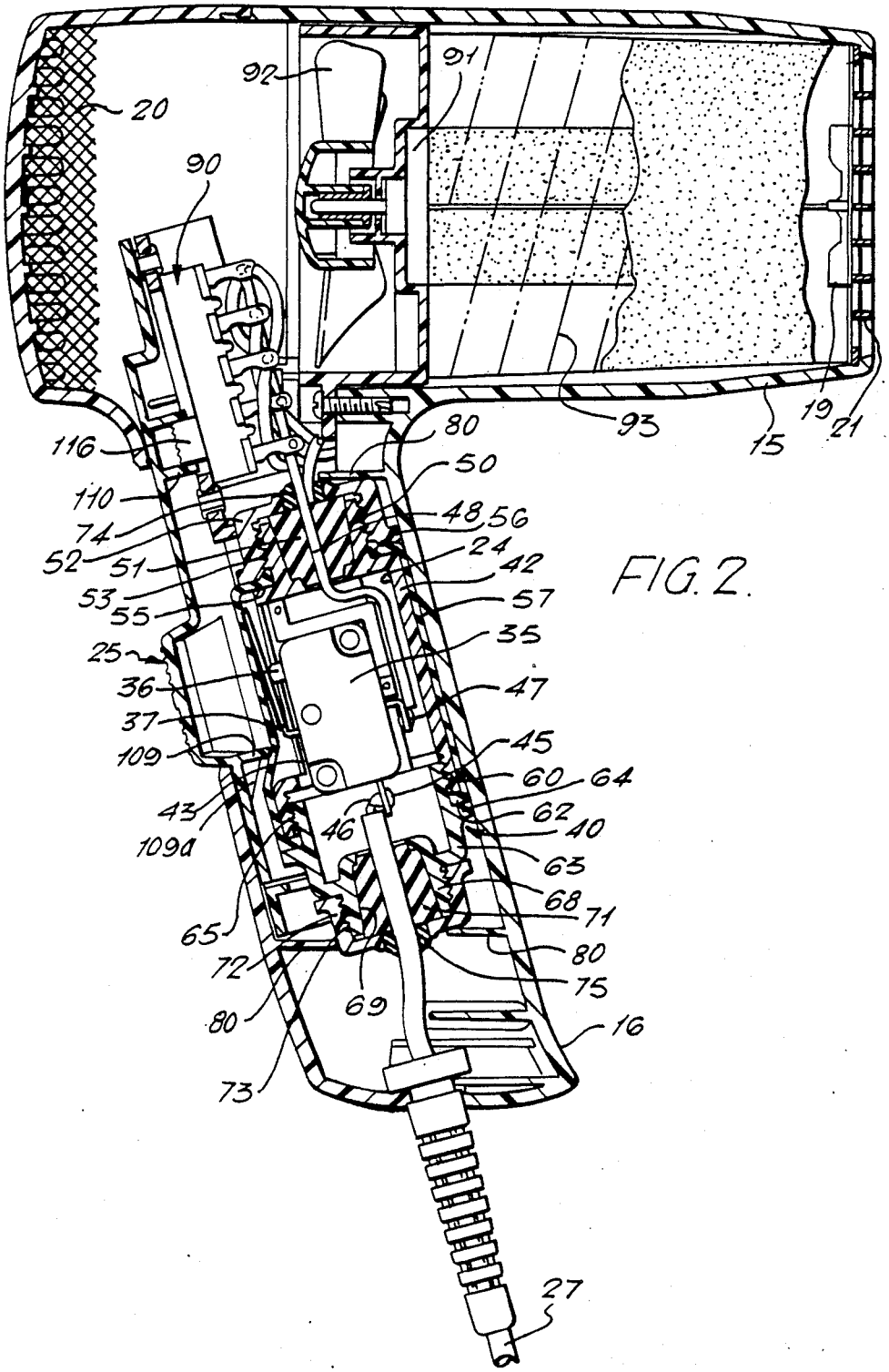
FIG. 2 is a section of the hair dryer taken on a central plane.

Returning to FIGS. 1, 2, 3 and 4 of the drawings, it will be seen that in the FIG. 2 position of the switch actuator 25 the raised grip portion 104 is at the lower end of the slot 26 in the housing portion 12 with the body 100 of the actuator within this housing portion. The lower edges 112 of main body 100 of the actuator 25 contact guides 114 formed as projections on the inside of housing member 11. The actuator body 100 is an easy fit within the housing portion 12, and the raised grip portion 104 is an easy fit within the slot 26. The switch actuator 25 is thus trapped for movement longitudinally of the slot by manual manipulation of the grip area 104. The actuator flange 109 contacts the sealing sleeve 57, but since it is out of register with the spring arms 37 of the switches 35, depression of the lever portion 101 could have no effect on the switches. Also the webs **109*a* prevent any substantial inward movement of the lever portion 101. This is the "off" position of the switch and corresponds to the mark on the markings 105**.

It will be seen that the box 110 on the actuator encloses a slider 116 controlling the switching arrangement 90. The movement of the actuator along its length causes a corresponding movement of slider 116.

Figure 3:
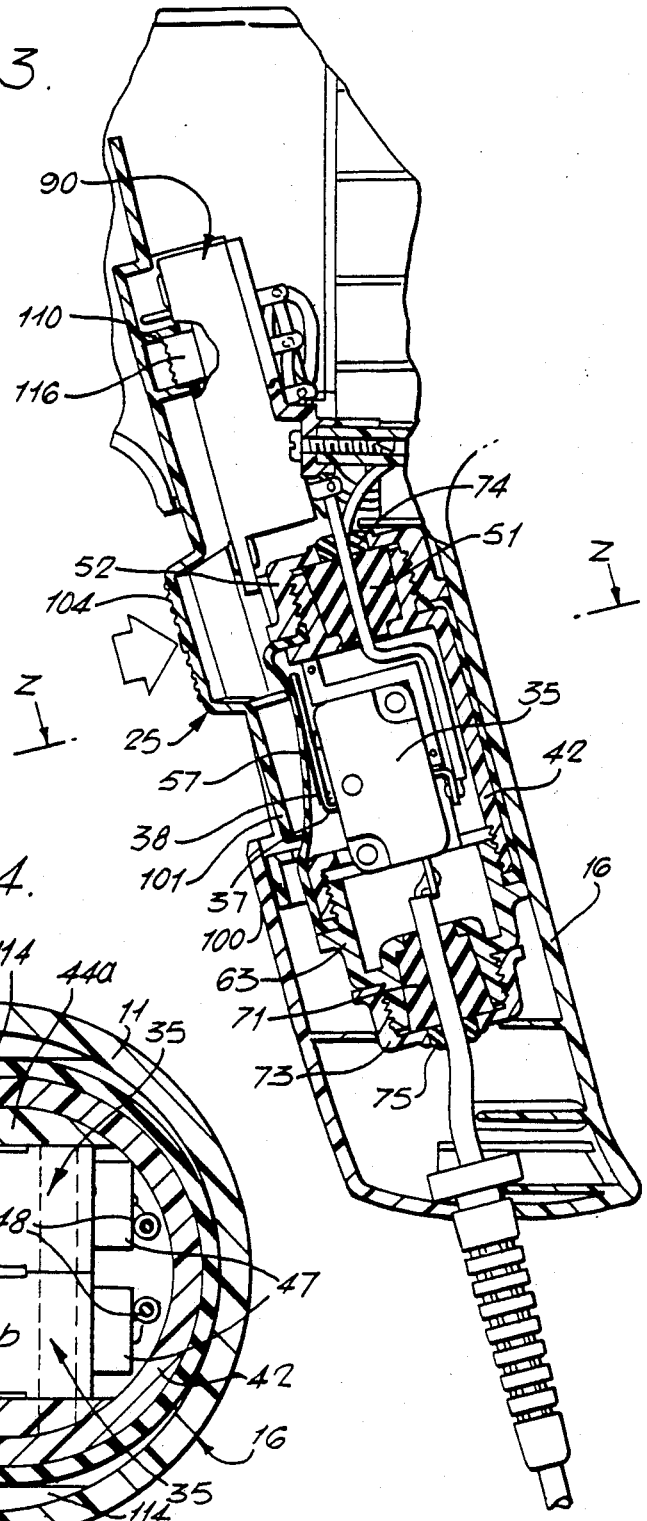
FIG. 3 is a partial sectional view corresponding to that FIG. 2 but showing parts in different positions.
Figure 4:
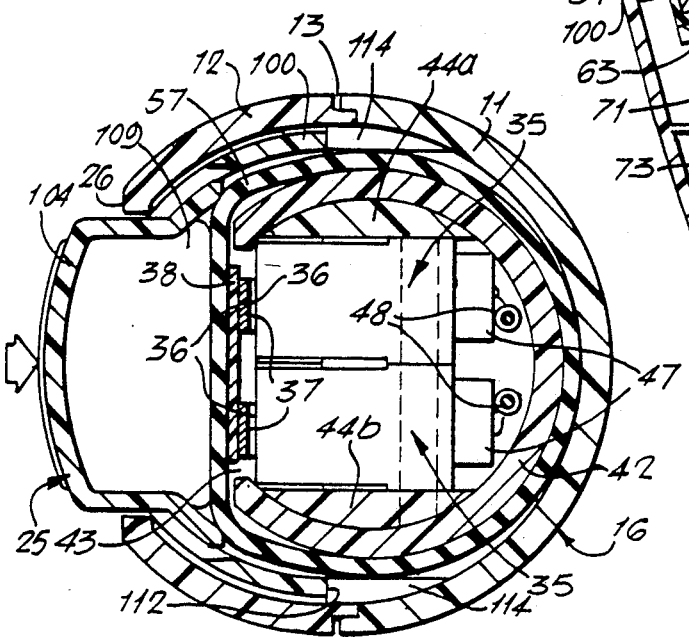
FIG. 4 is a transverse sectional view of the handle taken on the section line z—z in FIG. 3.

FIG. 3 shows the actuator in a position corresponding to mark 3 of the markings 105. It will be seen that the actuator flange 109 is now able to move the switch arms 37, by pressure applied through the sealing sleeve 57. As the actuator 25 is shown in FIGS. 3 and 4, the lever portion 101 is pressed inwards of the main body 100 against the restoring force due to the resilient neck 102, so that the switch arms 37 depress the push buttons 36 and bring the switches 35 to the closed position.

If the lever portion 101 of the actuator 25 is released, it will spring outwardly due to the resilient neck 102 and release the switch arms 37 thereby opening the switches 35. The only part of the hair dryer which remains live is the conductors 46 of the cord 27 and the input side of switches 35. However, these conductors and switches are completely sealed so that no danger arises from the immersion of the hair dryer.

The arrangement described is believed to comply with the requirements of safety specification of UL 859 for U.S., or CSA standard C22.2 No. 36 1979 for Canada, or B53456; Part 3; Section 3.13 1979.

Various modifications may be made in the apparatus described within the scope of the invention for example by replacing the two single pole switches 35 by a single double pole switch.

The invention described will be applicable to a hair dryer of any type. It will also by applicable to other appliances where similar requirements arise, such for example as a hand-held stab mixer, i.e. a mixer for food or liquid to be inserted and held by hand in a mixing bowl.

The invention includes also a hand-held appliance where the main switch is actuated separately from other switching.

We claim:

1. A hand held electrical appliance comprising a single housing with an insulated electrical supply cable extending thereinto for carrying electrical power from an external source; an enclosure within the housing having an electrically insulating and waterproof wall comprising a flexible wall portion, into which enclosure said supply cable passes through a first electrically insulating and waterproof seal member; two switches within the enclosure electrically connected on one side to two power lines from the supply cable, and electrically connected on their other side to two output conductors passing out of the enclosure through a second electrically insulating and waterproof seal member for powering the appliance, said housing wall and first and second seal members combining to seal said enclosure against the ingress of water; a manual pressure actuated lever also within the enclosure for closing the switches simultaneously to connect the power lines to the output conductors; spring means continuously biasing the lever to maintain the switches open in the absence of pressure being applied to the lever; and a button actuator mounted in the housing external of the enclosure but adjacent said flexible wall portion, said actuator being adapted for movement against said wall portion in response to manual pressure to actuate said lever against the force of said spring means to close said switches and activate the appliance so long as sufficient manual pressure is maintained, said button actuator being at all times electrically isolated from said lever and said switches by said insulating wall portion of said enclosure.

2. An appliance as claimed in claim 1, wherein the button actuator is movable in a direction at right angles to its direction of movement against said wall portion.

3. An appliance as claimed in claim 2, wherein the actuator is movable between open position and at least two closed positions for different appliance functions.

4. An appliance as claimed in claim 2, wherein the actuator in its open postion is out of register with the lever and in register with the lever in its closed position.

5. An appliance as claimed in claim 2, wherein the actuator is a one-piece resilient plastics member which by reason of its construction incorporates spring action to open the switch means in the absence of manual pressure.

6. An appliance as claimed in claim 5, wherein the actuator has a rigid body guided for longitudinal movement and a lever portion movable by manual pressure in a transverse direction, the lever portion being joined to the body at a neck allowing movement of the lever portion relative to the body and providing a restoring force.

7. An appliance as claimed in claim 6, having a handle, wherein the body is guided for longitudinal movement by the handle with the lever portion projecting through a slot in the handle.

8. An appliance as claimed in claim 7, including a subsidiary switching arrangement, the actuator body having a portion connecting with the subsidiary switching arrangement.

9. A hand held electrical appliance comprising a body and a handle defined by a single housing in which body an electric motor, a heater, and a fan are disposed, and with an insulated electrical supply cable extending into the handle for carrying electrical power from an external source; an enclosure within the handle having an electrically insulating and waterproof wall comprising a flexible wall portion, into which enclosure said supply cable passes through a first electrically insulating and waterproof seal member; two switches within the enclosure electrically connected on one side to two power lines from the supply cable, and electrically connected on their other side to two output conductors passing out of the enclosure through a second electrically insulating and waterproof seal member for powering the appliance, said housing wall and first and second seal members combining to seal said enclosure against the ingress of water; a subsidiary switching arrangement connected to said output conductors for controlling operation of the motor, heater and fan; a manual pressure actuated lever also within the enclosure for closing the switches simultaneously to connect the power lines to the output conductors; spring means continuously biasing the lever to maintain the switches open in the absence of pressure being applied to the lever; and a button actuator mounted in the housing external of the enclosure but adjacent said flexible wall portion, said actuator having a flange for actuating said lever and a slider for actuating the subsidiary switching arrangement, the flange being adapted for movement against said wall portion in response to manual pressure on the actuator in a first direction to actuate said lever against the force of said spring means to close said switches and activate the appliance so long as sufficient manual pressure is maintained, said button actuator being at all times electrically isolated from said lever and said switches by said insulating wall portion of said enclosure, and the actuator being movable in a second perpendicular direction to operate the switching arrangement and control the operation of the motor, heater and fan when connected by said two switches to said power source by the supply cable.

10. An appliance as claimed in claim 9, wherein the actuator is movable in said second direction between a base position and at least two control positions, and wherein said flange is out of register with said manual pressure actuated lever in said base position, and further comprising webs beneath the actuator preventing movement thereof in said first direction when the button actuator is in said base position.

* * * * *